US011443712B2

(12) United States Patent
Ozawa

(10) Patent No.: US 11,443,712 B2
(45) Date of Patent: Sep. 13, 2022

(54) DISPLAY DEVICE AND METHOD OF CONTROLLING A DISPLAY MODE OF THE DISPLAY DEVICE TO SELECTIVELY DISPLAY A SELECTION SCREEN AND AN IMAGE SCREEN

(71) Applicant: SEIKO EPSON CORPORATION, Tokyo (JP)

(72) Inventor: Takaaki Ozawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/813,953

(22) Filed: Mar. 10, 2020

(65) Prior Publication Data

US 2020/0294465 A1 Sep. 17, 2020

(30) Foreign Application Priority Data

Mar. 11, 2019 (JP) ..... JP2019-043425

(51) Int. Cl.
*G09G 3/36* (2006.01)
*G09G 5/00* (2006.01)

(52) U.S. Cl.
CPC ..... *G09G 5/006* (2013.01); *G09G 2354/00* (2013.01); *G09G 2370/20* (2013.01)

(58) Field of Classification Search
CPC . G09G 5/006; G09G 2370/20; G09G 2354/00
See application file for complete search history.

(56) References Cited

U.S. PATENT DOCUMENTS

2006/0203133 A1* 9/2006 Fujiwara ..... H04N 21/47 348/744
2006/0221255 A1* 10/2006 Okubo ..... H04N 5/268 348/706
2009/0213279 A1* 8/2009 Ichieda ..... H04N 9/3179 348/734
2011/0090409 A1* 4/2011 Kawasaki ..... G03B 37/04 348/744
2011/0115983 A1* 5/2011 Nishihata ..... H04N 9/641 348/705
2012/0050238 A1* 3/2012 Kasahara ..... G09G 5/006 345/204

(Continued)

FOREIGN PATENT DOCUMENTS

JP 2001-215942 A 8/2001
JP 2003-288069 A 10/2003

(Continued)

*Primary Examiner* — Adam J Snyder
(74) *Attorney, Agent, or Firm* — Oliff PLC

(57) ABSTRACT

A projector selects an image of a home screen as an image to be displayed by a display section even when input of an image signal to the interface section is detected when the home screen has been displayed on the grounds that an operation has been received by a remote controller or an operation panel, and changes the image to be displayed by the display section from the image of the home screen to the image based on the image signal the input of which has been detected when the input of the image signal to the interface section is detected when the home screen has been displayed on the grounds that no input of the image signal to the interface section has been detected.

6 Claims, 7 Drawing Sheets

(56) References Cited

U.S. PATENT DOCUMENTS

| | | | | |
|---|---|---|---|---|
| 2012/0086680 | A1* | 4/2012 | Ueda | H04N 21/4221<br>345/204 |
| 2013/0154904 | A1 | 6/2013 | Sasaki | |
| 2017/0111697 | A1* | 4/2017 | Choi | H04N 21/42222 |

FOREIGN PATENT DOCUMENTS

| | | | |
|---|---|---|---|
| JP | 2010-176060 | A | 8/2010 |
| JP | 2013-149244 | A | 8/2013 |

* cited by examiner

DISPLAY DEVICE AND METHOD OF CONTROLLING A DISPLAY MODE OF THE DISPLAY DEVICE TO SELECTIVELY DISPLAY A SELECTION SCREEN AND AN IMAGE SCREEN

The present application is based on, and claims priority from JP Application Serial Number 2019-043425, filed Mar. 11, 2019, the disclosure of which is hereby incorporated by reference herein in its entirety.

BACKGROUND

1. Technical Field

The present disclosure relates to a method of controlling a display device and a display device.

2. Related Art

In the past, a display device is provided with a plurality of interfaces for coupling to an external device, and when input of an image signal is detected in the interface to which no image signal has been input, the display device displays an image based on the image signal input to that interface.

For example, the display device disclosed in JP-A-2010-176060 monitors presence or absence of a signal input to each of video source terminals to detect the fact that the video source terminal with no signal input has turned to the video source terminal with signal input, and then selects the video source terminal as a display target.

When there is adopted a configuration of detecting input of the image signal to the interface to display an image based on the image signal input to the interface the input to which has been detected, the display image is switched at an unintended timing for a user in some cases.

SUMMARY

An aspect of the present disclosure is directed to a method of controlling a display device including a screen display step of displaying by a display section a selection screen used to select any of interfaces one of when no input of an image signal to a coupling section provided with the interfaces and coupled to an external device is detected and when an operation was received by a reception section, a detection step of detecting input of an image signal to the coupling section, and a selection step of selecting an image to be displayed by the display section, wherein in the selection step, when the selection screen was displayed in the screen display step on grounds that the operation was received by the reception section, an image of the selection screen is selected as the image to be displayed by the display section even when the input of the image signal to the coupling section was detected, and in the selection step, when the selection screen was displayed in the screen display step on grounds that no input of the image signal to the coupling section was detected, an image based on the image signal the input of which was detected is selected as the image to be displayed by the display section when the input of the image signal to the coupling section is detected.

The method of controlling a display device described above, may be configured such that, in the selection step, when the input of the image signal is detected after displaying the selection screen, when a first condition is set as a selection condition for selecting the image to be displayed by the display section, the image based on the image signal input of which was detected is selected as the image to be displayed by the display section when the selection screen was displayed on grounds that the operation was received by the reception section and when the selection screen was displayed on grounds that no input of the image signal to the coupling section was detected.

The method of controlling a display device described above may be configured such that, in the selection step, when the input of the image signal is detected after displaying the selection screen, when a second condition is set as a selection condition for selecting the image to be displayed by the display section, the image of the selection screen is selected as the image to be displayed by the display section when the selection screen was displayed on grounds that the operation was received by the reception section and when the selection screen was displayed on grounds that no input of the image signal to the coupling section was detected.

The method of controlling a display device described above may be configured such that, in the selection step, when the input of the image signal is detected after displaying the selection screen, when a third condition is set as a selection condition for selecting the image to be displayed by the display section, when the selection screen was displayed on grounds that the operation was received by the reception section, an image of the selection screen is selected as the image to be displayed by the display section even when the input of the image signal to the coupling section was detected, and when the selection screen was displayed on grounds that no input of the image signal to the coupling section was detected, the image to be displayed by the display section is changed from the image of the selection screen to an image based on the image signal the input of which was detected when the input of the image signal to the coupling section is detected.

The method of controlling a display device described above may be configured such that a plurality of sub-screens respectively associated with the interfaces is displayed in the selection screen, images based on the image signals input to the interfaces with which the sub-screens are associated are respectively displayed in the plurality of sub-screens, and in the selection step, when an operation of selecting any of the sub-screens is received by the reception section, the image to be displayed by the display section is changed from the selection screen to the image based on the image signal input to the interface associated with the sub-screen selected by the operation received by the reception section.

Another aspect of the present disclosure is directed to a display device including a display section, a reception section configured to receive an operation, a coupling section provided with a plurality of interfaces and coupled to an external device, a detection section configured to detect input of an image signal to the coupling section, and a display control section configured to make the display section display a selection screen used to select any of the interfaces one of when no input of the image signal to the coupling section is detected and when an operation was received by the reception section, wherein when the selection screen was displayed on grounds that the operation was received by the reception section, the display control section selects an image of the selection screen as the image to be displayed by the display section even when the input of the image signal to the coupling section was detected, and when the selection screen was displayed on grounds that no input of the image signal to the coupling section was detected, the display control section changes the image to be displayed by the display section from the image of the selection screen to an image based on the image signal the input of which was detected when the input of the image signal to the coupling section is detected.

DESCRIPTION OF EXEMPLARY EMBODIMENTS

Some embodiments will hereinafter be described with reference to the accompanying drawings.

Figure 1:
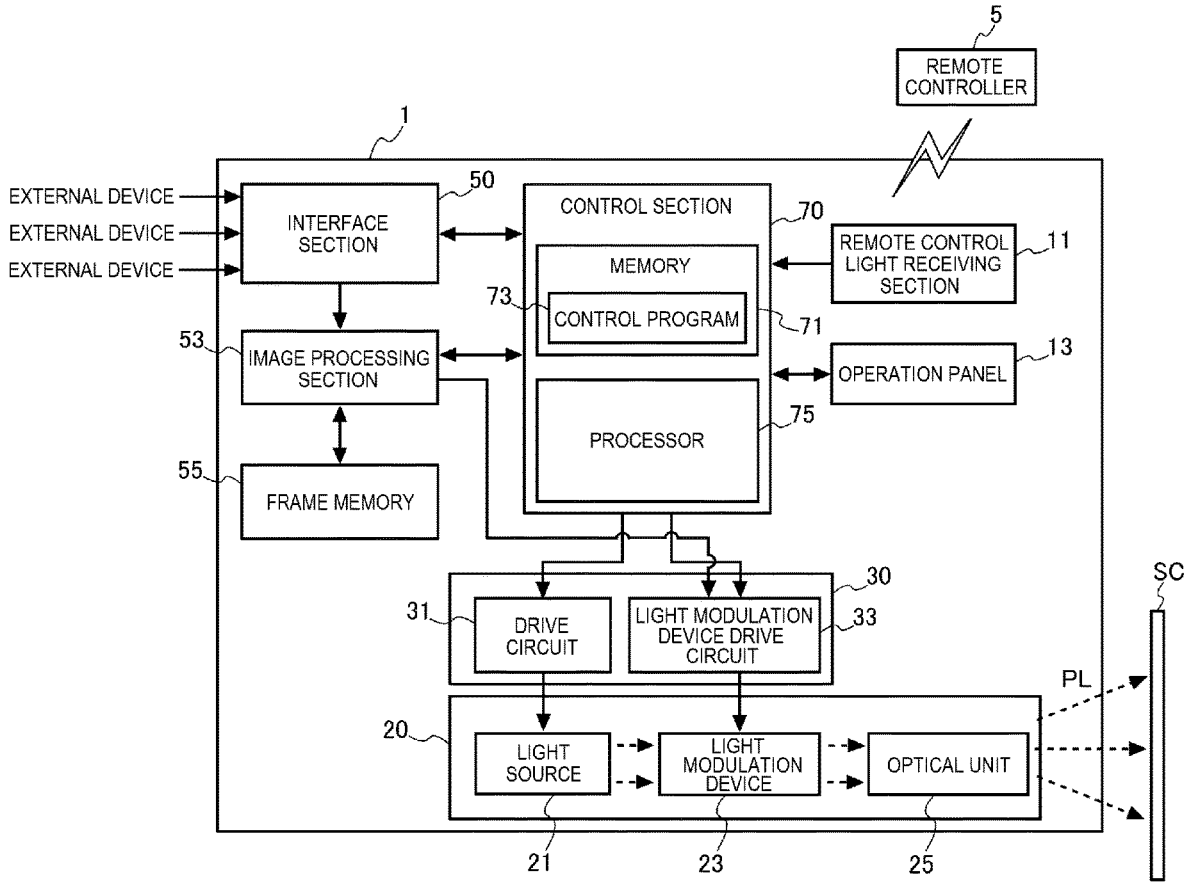
FIG. 1 is a block diagram showing a configuration of a projector.

FIG. 1 is a block diagram showing a configuration of a projector 1 as an example of a display device.

The projector 1 is provided with a reception section, an image projection system, an image processing system, and a control section 70 as principal constituents. The image projection system generates image light PL as an optical image, and then projects the image light PL on a screen SC. The image processing system electrically processes image data as a base of the optical image.

The projector 1 is installed on, for example, a desk, a table, or the floor in a horizontal posture. As the installation method of the projector 1, installation methods such as wall-hanging installation in which the projector 1 is mounted on the wall, or ceiling-suspended installation in which the projector 1 is suspended from the ceiling can be cited besides the above. The projector 1 according to the present embodiment can be installed with any of the methods.

Further, there is described when a projection surface on which the projector 1 projects the image light PL is the screen SC as an example in the present embodiment, but it is also possible to use an external wall, an internal wall, or the like of a building or the like as the projection surface.

The projector 1 is provided with a remote control light receiving section 11 and an operation panel 13 as the reception section.

The remote control light receiving section 11 receives an infrared signal transmitted by a remote controller 5. The remote controller 5 also functions as a part of the reception section. The remote control light receiving section 11 outputs an operation signal corresponding to the infrared signal thus received to the control section 70. The operation signal is a signal corresponding to a switch of the remote controller 5 operated.

The operation panel 13 is disposed in, for example, a housing of the projector 1, and is provided with a variety of switches such as a power switch for switching ON and OFF the projector 1. When a switch of the operation panel 13 is operated, the operation signal corresponding to the switch thus operated is input to the control section 70.

The image projection system is provided with a display section 20 and a drive section 30 for driving the display section 20. The display section 20 is provided with alight source 21, a light modulation device 23, and an optical unit 25. The drive section 30 is provided with a drive circuit 31 and a light modulation device drive circuit 33.

As the light source 21, there is used a lamp light source such as a halogen lamp, a xenon lamp, or a super high-pressure mercury lamp. Further, as the light source 21, there can be used a solid-state light source such as an LED (Light Emitting Diode) or a laser source.

To the light source 21, there is coupled the drive circuit 31. The drive circuit 31 is coupled to the light source 21 and the control section 70, and supplies the light source 21 with a drive current or a pulse in accordance with the control by the control section 70 to put the light source 21 on or off.

The light modulation device 23 is provided with light modulation elements for modulating light emitted by the light source 21 to generate the image light PL. The light modulation device 23 emits the image light PL modulated by the light modulation elements to the optical unit 25. As the light modulation elements, there can be used, for example, transmissive liquid crystal light valves, reflective liquid crystal light valves, or digital mirror devices.

To the light modulation device 23, there is coupled a light modulation device drive circuit 33. The light modulation device drive circuit 33 is coupled to the control section 70 and the light modulation device 23, and drives the light modulation device 23 in accordance with the control by the control section 70 to draw an image on the light modulation elements frame by frame. For example, when the light modulation device 23 is formed of liquid crystal light valves, the light modulation device drive circuit 33 is formed of a driver circuit for driving the liquid crystal.

The optical unit 25 is provided with an optical element such as a lens or a mirror, and projects the image light PL modulated by the light modulation device 23 toward the screen SC. Thus, the image based on the image light PL is imaged on the screen SC.

Then, an image processing system of the projector 1 will be described.

The projector 1 is provided with an interface section 50, an image processing section 53, and a frame memory 55 as the image processing system.

The interface section 50 is a coupling section for coupling the projector 1 to an external device, and is provided with a plurality of interfaces. The interfaces provided to the interface section 50 can be wired interfaces, or can also be wireless interfaces. Further, the wired interfaces can be interfaces to which image data is input, or can also be communication interfaces for data communication.

The interface section 50 receives the image signal from the external device coupled to the projector 1, and then takes out the image data and sync signals included in the image signal thus received. The interface section 50 outputs the image data and the sync signals thus taken out to the image processing section 53. Further, the interface section 50 outputs the sync signals thus taken out to the control section 70. The image processing section 53 processes one frame of the image data in sync with the sync signals thus input, and then outputs the image data having been processed to the light modulation device drive circuit 33. The control section 70 controls each section of the projector 1 in sync with the sync signals input. One frame corresponds to a period in which an image corresponding to one screen is displayed. Further, one frame of the image data is image data displayed in a vertical scanning period defined by a vertical sync signal included in the sync signals.

Figure 2:
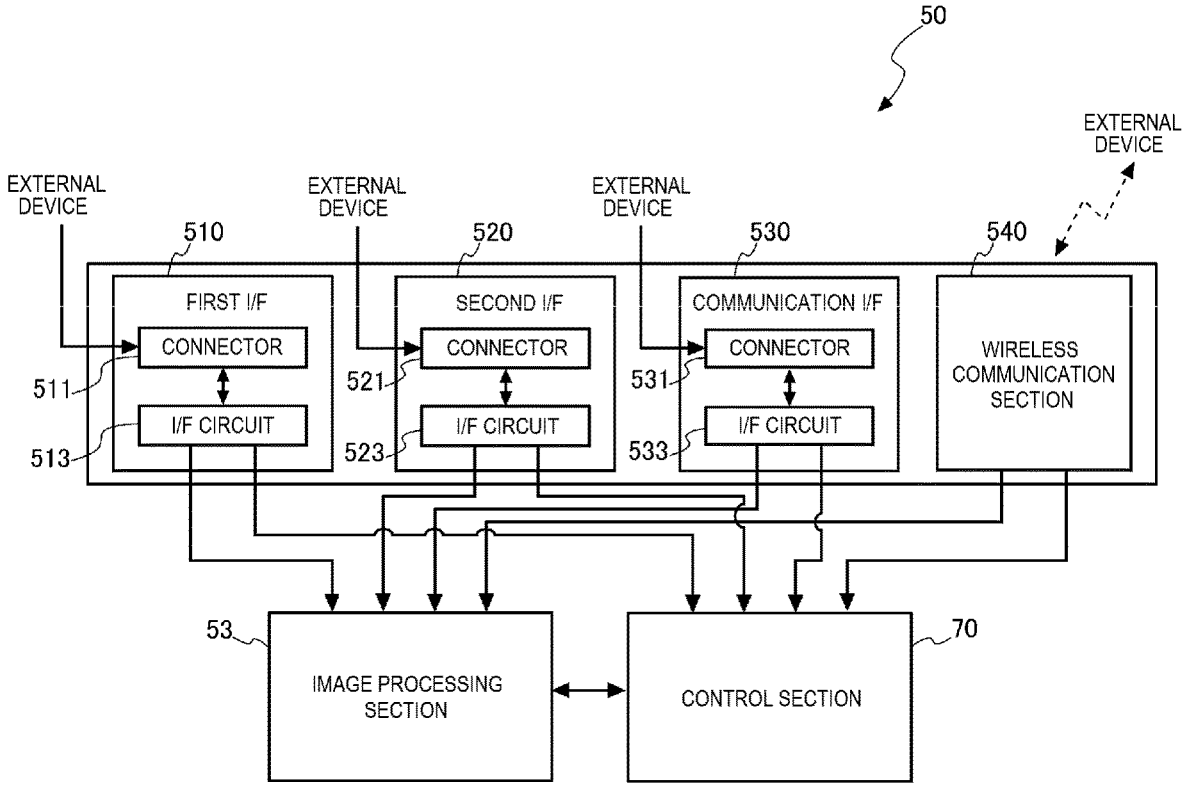
FIG. 2 is a block diagram showing a configuration of an interface section.

FIG. 2 is a block diagram showing a detailed configuration of the interface section 50. The configuration of the interface section 50 will be described with reference to FIG. 2. The interface section 50 corresponds to an example of the "coupling section." The section 50 in the present embodiment is provided with a first interface 510, a second interface 520, a communication interface 530, and a wireless communication section 540. In the present embodiment, there is described when the interface section 50 is provided with the four interfaces, namely the first interface 510, the second interface 520, the communication interface 530, and the wireless communication section 540, but the number of the interfaces provided to the interface section 50 is arbitrary. Further, in the present embodiment, there is described when the standards of the plurality of interfaces provided to the interface section 50 are different from each other, but can have a configuration provided with a plurality of interfaces the same in standard such as HDMI (High-Definition Multimedia Interface).

The first interface 510 is a digital interface such as DVI (Digital Visual Interface), HDMI, Display Port, or HDBaseT. The first interface 510 is provided with a connector 511 and an interface circuit 513 compatible with the standard of the digital interface. The interface circuit 513 corresponds to an example of a "detection section." HDMI and HDBaseT are each a registered trademark.

To the first interface 510, there is input a digital image signal.

The interface circuit 513 is provided with, for example, a conversion section for performing a serial-to-parallel conversion on the image signal, and performs the conversion with the conversion section to convert the image signal thus input into a parallel image signal when the image signal thus input is the image signal having a serialized digital format such as HDMI. Therefore, the illustration of the conversion section will be omitted. For example, the interface circuit 513 detects the fact that the image signal has been input to the conversion section, and then notifies the control section 70 of the input of the image signal.

Further, it is also possible for the interface circuit 513 to determine that the input of the image signal has been detected and then notify the control section 70 of the input of the image signal when the interface circuit 513 has detected the coupling of the external device to the first interface 510. For example, an HPD (Hot Plug Detect) line is included in a cable for coupling the external device and the interface circuit 513 to each other, and the interface circuit 513 detects a voltage change at the terminal to which the HPD line is coupled to detect the connection of the external device.

The second interface 520 is an analog interface such as VGA (Video Graphics Array), a D-terminal, or an S-terminal. The second interface 520 is provided with a connector 521 and an interface circuit 523 compatible with the standard of the analog interface. The interface circuit 523 corresponds to an example of the "detection section."

To the second interface 520, there is input an analog image signal.

The interface circuit 523 is provided with, for example, an A/D converter, and converts the analog image signal thus input into the digital image data with the A/D converter. The illustration of the A/D converter will be omitted. For example, the interface circuit 523 detects the fact that the image signal has been input to the A/D converter, and then notifies the control section 70 of the input of the image signal.

Further, it is also possible for the interface circuit 523 to determine that the input of the image signal has been detected and then notify the control section 70 of the input of the image signal when the interface circuit 523 has detected the coupling of the external device to the second interface 520. Similarly to the interface circuit 513, the interface circuit 523 also detects the voltage change at the terminal to which the HPD line is coupled to detect the connection of the external device.

The communication interface 530 is a communication interface such as USB (Universal Serial Bus), Ethernet, or IEEE 1394. Ethernet is a registered trademark. The communication interface 530 is provided with a connector 531 and an interface circuit 533 compatible with the standard of the communication interface. The interface circuit 533 corresponds to an example of the "detection section."

It is also possible for the interface circuit 533 to detect an electrical change of a voltage or the like of the connector 531 coupled to a signal line through which data is transmitted and received to detect the input of the image signal. The signal line is a signal line included in the cable for coupling the projector 1 and the external device to each other. Further, it is also possible for the interface circuit 533 to detect the input of the image signal when the interface circuit 533 has received a request of data transmission from the external device coupled to the interface circuit 533.

The wireless communication section 540 is a communication module including an antenna, an RF circuit, a baseband circuit, and so on. The wireless communication section 540 performs the wireless communication such as Bluetooth, wireless LAN including Wi-Fi, or NFC (Near Field Communication). Bluetooth and Wi-Fi are registered trademarks. The wireless communication section 540 corresponds to an example of the "detection section."

When an initialization process such as a negotiation process has been completed, and the request of the image signal transmission has been received from the external device wirelessly coupled to the wireless communication section 540, or when the data such as packet data has been received from the external device, the wireless communication section 540 determines that the image signal has been input, and notifies the control section 70 of the input of the image signal.

As the external device to be coupled to the interface section 50, there can be cited, for example, a laptop PC (Personal Computer), a desktop PC, a tablet terminal, a smartphone, and a PDA (Personal Digital Assistant). Further, as the external device, there can be cited, for example, a video reproduction device, a DVD player, a Blu-ray disc player, and so on. Further, as the external device, there can be cited a hard disk recorder, a television tuner device, a set-top box of a CATV (Cable Television), a video game machine, a device such as a USB memory device or an input device, and so on.

Going back to FIG. 1, the configuration of the projector 1 will continuously be described.

To the image processing section 53, there is coupled a frame memory 55. The data having been input from the interface section 50 is developed in the frame memory 55 by the image processing section 53. The frame memory 55 is provided with a plurality of banks. Each of the banks has a storage capacity sufficient for writing the image data corresponding to one frame. The frame memory 55 is formed of, for example, an SDRAM (Synchronous Dynamic Random Access Memory). In the present embodiment, the frame memory 55 is provided with, for example, the four banks corresponding to the respective interfaces, namely the first interface 510, the second interface 520, the communication interface 530, and the wireless communication section 540. When the plurality of interfaces respectively receives the image signals, the image processing section 53 develops the image data retrieved from the image signals thus received in the respective banks of the frame memory 55.

The image processing section 53 performs image processing on the image data having been developed in the frame memory 55. In the image processing performed by the image processing section 53, there are included, for example, a resolution conversion process or a resizing process, correction of a distortion aberration, a shape correction process, a digital zooming process, and an adjustment of the color shade or the luminance of the image. The image processing section 53 executes the process designated by the control section 70, and executes the process using a parameter input from the control section 70 as needed. Further, it is obviously possible for the image processing section 53 to execute two or more of the processes described above in combination with each other. The image processing section 53 retrieves the image data having been developed in the bank selected by the control section 70 from the frame memory 55, and then outputs the image data to the light modulation device drive circuit 33.

The image processing section 53 and the frame memory 55 are formed of, for example, an integrated circuit. The integrated circuit includes an LSI, an ASIC (Application Specific Integrated Circuit), a PLD (Programmable Logic Device), an FPGA (Field-Programmable Gate Array), an SoC (System-on-a-Chip), and so on. Further, it is also possible for an analog circuit to be included in a part of the configuration of the integrated circuit, or it is also possible to adopt a configuration having the control section 70 and the integrated circuit combined with each other.

Then, a configuration of the control section 70 will be described. The control section 70 is a computer device provided with a memory 71 and a processor 75. The memory 71 is provided with a volatile memory such as a RAM (Random Access Memory), and a nonvolatile memory such as a ROM (Read Only Memory) or a flash memory. The memory 71 stores a control program 73 to be executed by the processor 75. Further, the memory 71 stores a value of a flag for setting an automatic input detection function valid or invalid. The automatic input detection function is a function of displaying an image based on an image signal input of which is detected instead of the image having been displayed until then when the input of the image signal is detected.

The processor 75 is an arithmetic processing device formed of a CPU (Central Processing Unit) or a microcomputer. The processor 75 executes the control program 73 to control each section of the projector 1. The processor 75 can be formed of a single processor, or can also be formed of a plurality of processors. Further, the processor 75 can also be formed of an SoC (System-on-a-Chip) integrated with apart or the whole of the memory 71 and other circuits. Further, the processor 75 can also be formed of a combination of a CPU for executing a program and a DSP (Digital Signal Processor) for executing an arithmetic process. Further, it is also possible to adopt a configuration in which all of the functions of the processor 75 are implemented in the hardware, or it is also possible to configure all of the functions of the processor 75 using a programmable device.

The control section 70 is an example of a display control section, and the processor 75 executes an instruction set described in the control program 73 to perform calculation and control of the data, and thus performs the following process.

When the control section 70 receives an operation of selecting the interface with the remote controller 5 or the operation panel 13, the control section 70 displays an image based on the image signal to be input to the interface thus selected. Specifically, the control section 70 designates the bank which is to be processed by the image processing section 53, and retrieves a parameter used for the image processing from the memory 71 and then outputs the parameter to the image processing section 53. The image processing section 53 performs the image processing on the image data having been developed in the bank designated by the control section 70, and then outputs the image data having been processed to the light modulation device drive circuit 33.

Further, the control section 70 controls the drive section 30 to make the display section 20 generate the image light PL, and then project the image light PL having been generated on the screen SC. In accordance with the control by the control section 70, the light modulation device drive circuit 33 generates a drive signal for driving the light modulation elements based on the image data thus input. The light modulation device drive circuit 33 drives the light modulation elements with the drive signal thus generated to control the transmittance of the light modulation elements to become the transmittance corresponding to the image data. The light emitted by the light source 21 is transmitted through the light modulation elements controlled in the transmittance to thereby be modulated into the image light PL. The light having been modulated into the image light PL is projected on the screen SC by the optical unit 25, and thus, the image based on the image data is displayed on the screen SC.

Further, the control section 70 selects the screen to be displayed on the screen SC based on the input state of the image signal to the interface section 50 and the operation having been received by the remote controller 5 and the operation panel 13. In the present embodiment, the control section 70 displays two screens, namely an input signal screen 100 and a home screen 110.

Figure 3:
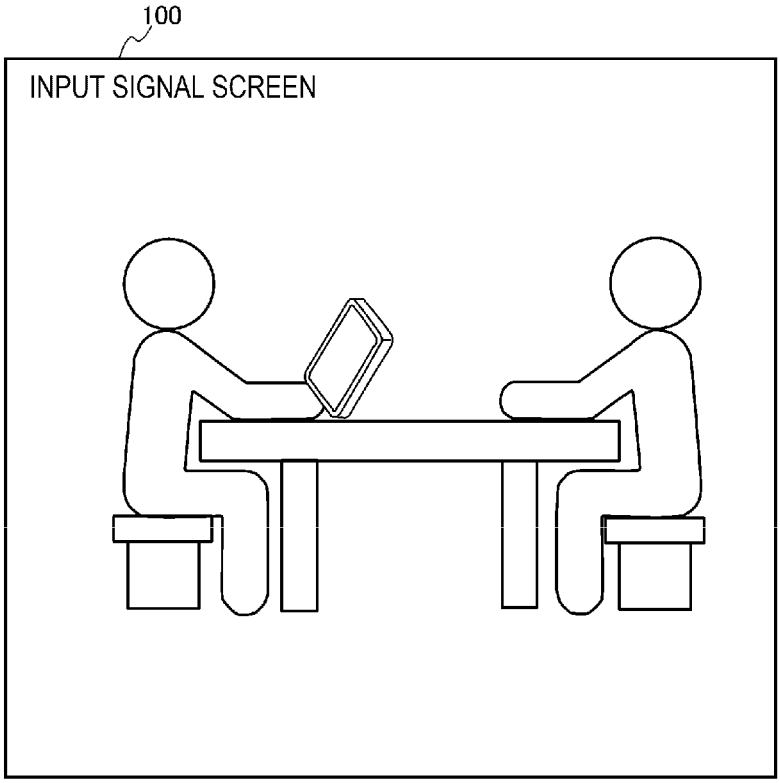
FIG. 3 is a diagram showing an example of an input signal screen.

FIG. 3 is a diagram showing an example of the input signal screen 100. The input signal screen 100 is a screen in which the image based on the image signal input to any one of the interfaces of the interface section 50 is displayed. When the automatic input detection function is set valid, and the input of the image signal is detected in any one of the interfaces provided to the interface section 50, the control section 70 displays the image based on the image signal the input of which has been detected on the screen SC. Further, when the control section 70 receives an operation of selecting any one of the interfaces with the remote controller 5 or the operation panel 13 in the state in which the home screen 110 is displayed, the control section 70 displays the image based on the image signal input to the interface thus selected on the screen SC.

Figure 4:
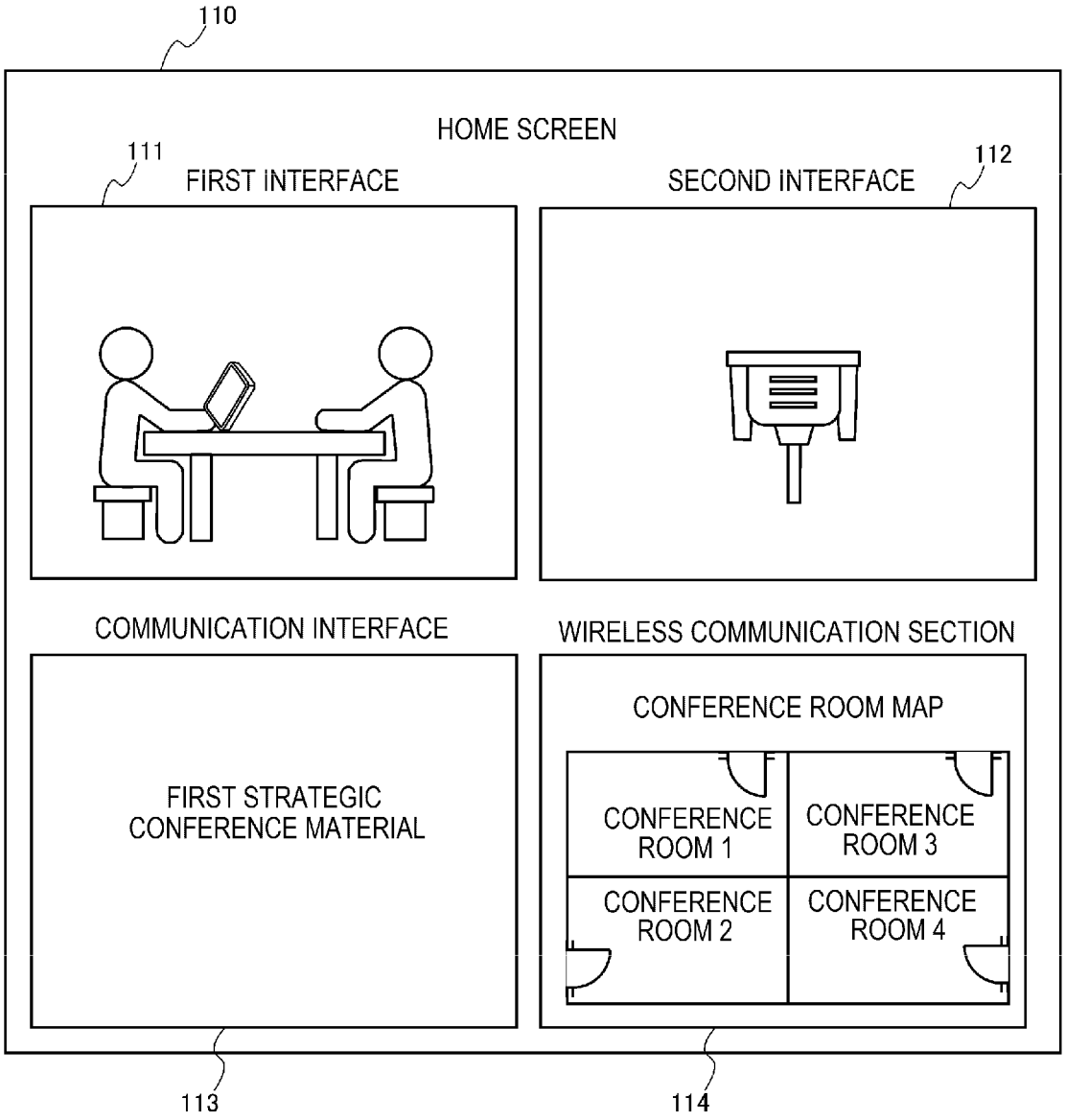
FIG. 4 is a diagram showing an example of a home screen.

FIG. 4 is a diagram showing an example of the home screen 110.

The home screen 110 is a selection screen, and is a screen for selecting the image to be displayed as the input signal screen 100 or the interface. In the home screen 110, there is displayed a plurality of sub-screens corresponding respectively to the interfaces provided to the interface section 50. In the home screen 110 in the present embodiment, there are displayed four sub-screens, namely the sub-screen 111, the sub-screen 112, the sub-screen 113, and the sub-screen 114.

The sub-screen 111 is associated with the first interface 510, and when the image signal is input to the first interface 510, the image based on the image signal thus input is displayed in the sub-screen 111. The sub-screen 112 is associated with the second interface 520, and when the image signal is input to the second interface 520, the image based on the image signal thus input is displayed in the sub-screen 112.

The sub-screen 113 is associated with the communication interface 530, and when the image signal is input to the communication interface 530, the image based on the image signal thus input is displayed in the sub-screen 113. The sub-screen 114 is associated with the wireless communication section 540, and when the image signal is input to the wireless communication section 540, the image based on the image signal thus input is displayed in the sub-screen 114.

In the present embodiment, thumbnail images as the images based on the image signals are displayed in the corresponding sub-screens 111 through 114. Further, in the sub-screens 111 through 114 corresponding to the interfaces to which not image signals are input, an image based on the image signal is not displayed, but an image set in advance is displayed. In the present embodiment, images of the connectors 511, 521, and 531, for example, are used as the image set in advance.

When none of the interface circuit 513, the interface circuit 523, the interface circuit 533, and the wireless communication section 540 functioning as the detection section can detect the input of the image signal, the control section 70 displays the home screen 110 on the screen SC. When none of the plurality of interfaces has detected the input of the image signal, and the control section 70 has displayed the home screen 110, the control section 70 sets the automatic input detection function valid. The control section 70 rewrites the value of the flag for switching between the valid state and the invalid state of the automatic input detection function to a value corresponding to the valid state. By the automatic input detection function being set valid, when the input of the image signal has been detected in any one of the interfaces, the image based on the image signal the input of which has been detected is displayed as the input signal screen 100.

Further, when the control section 70 has received the operation of instructing the display of the home screen 110 with the remote controller 5 or the operation panel 13, the control section 70 also displays the home screen 110 on the screen SC. When the control section 70 has displayed the home screen 110 in accordance with the operation of the remote controller 5 or the operation panel 13, the control section 70 sets the automatic input detection function invalid. The control section 70 rewrites the value of the flag for switching between the valid state and the invalid state of the automatic input detection function to a value corresponding to the invalid state. By the automatic input detection function being set invalid, even when the input of the image signal has been detected in any one of the interfaces, the home screen 110 is continuously displayed. When receiving the operation of the remote controller 5 or the operation panel 13 to display the home screen 110, the home screen 110 is displayed at the desire of the user. Therefore, by setting the automatic input detection function invalid, it is possible to continuously display the home screen 110 even when the input of the image signal is detected.

Further, in the home screen 110, there is displayed the plurality of sub-screens 111 through 114.

The user refers to the display of the sub-screens 111 through 114, and then selects one of the sub-screens 111 through 114 the image of which is desired to be displayed out of the sub-screens 111 through 114 to which the image signals are input, and the thumbnail images of which are displayed. When the control section 70 has received the operation of selecting any one of the sub-screens 111 through 114 with the remote controller 5 or the operation panel 13, the control section 70 sets the image signal to be input to the interface associated with one of the sub-screens 111 through 114 selected by the operation as the processing target image signal. The control section 70 makes the image processing section 53 process the processing target image signal, and controls the drive section 30 to make the display section 20 generate the image light PL based on the image signal. The image light PL thus generated is projected on the screen SC by the optical unit 25.

Figure 5:
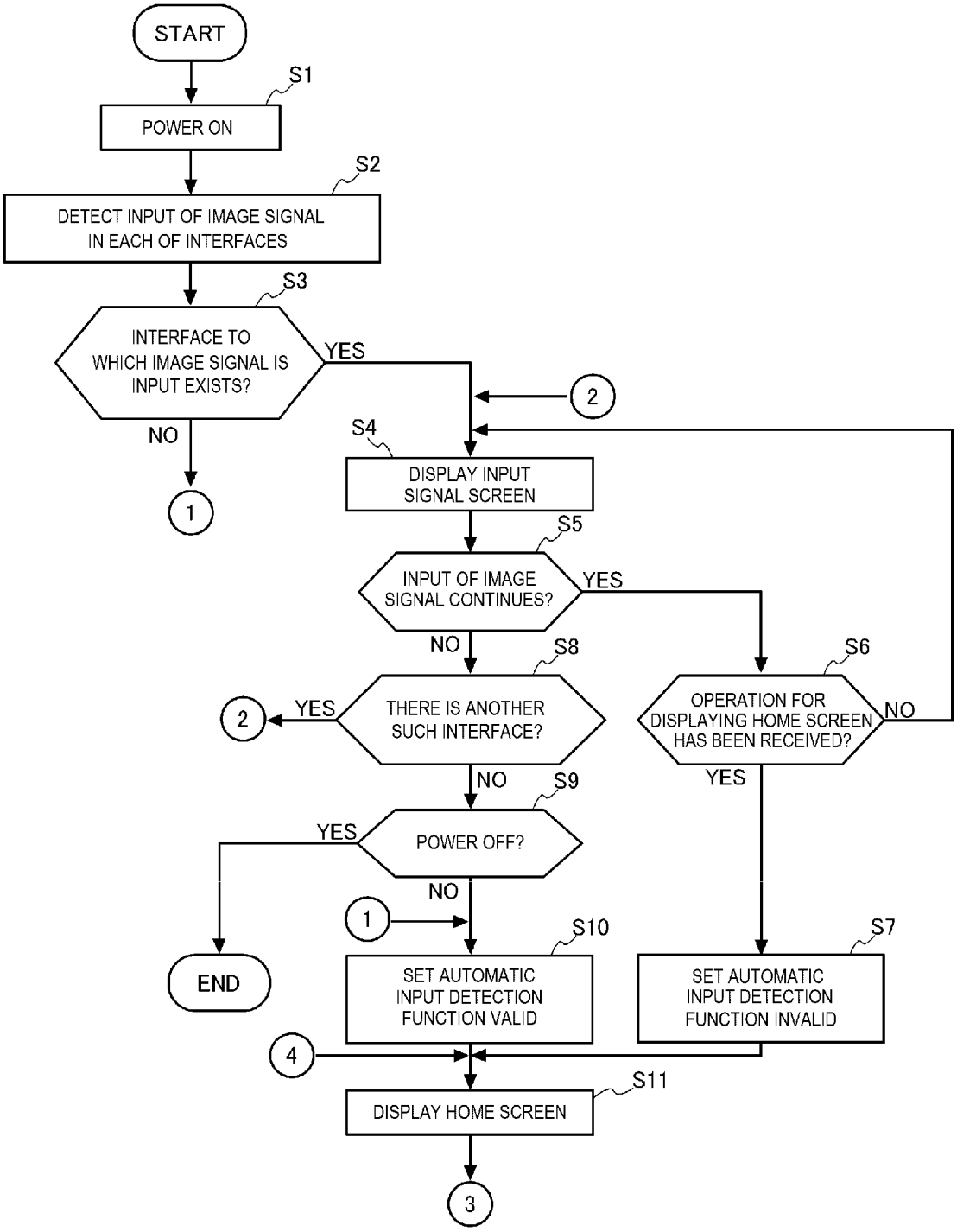
FIG. 5 is a flowchart showing an operation of a first embodiment.
Figure 6:
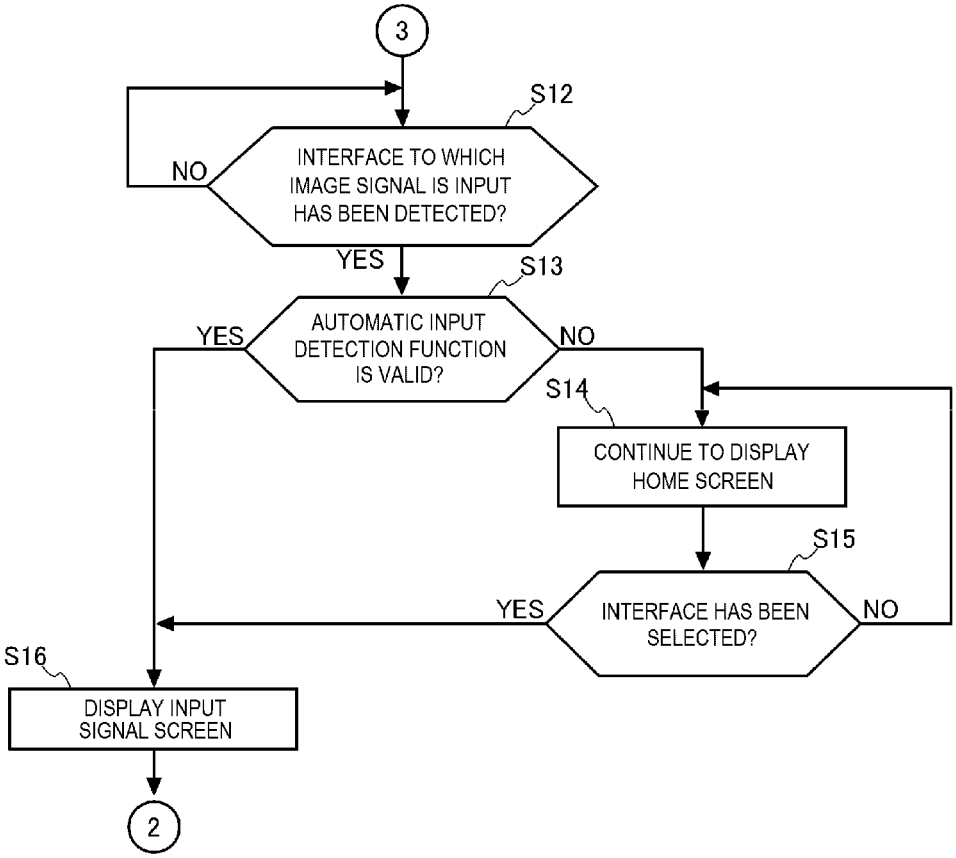
FIG. 6 is a flowchart showing the operation of the first embodiment.

FIG. 5 and FIG. 6 correspond to a flowchart showing the operation of the projector 1.

The operation of the projector 1 will be described with reference to the flowchart shown in FIG. 5 and FIG. 6.

When the power switch is set ON (step S1) and the projector 1 is switched ON, the control section 70 starts up, and determines (step S2) whether or not input of an image signal exists in each of the interfaces of the interface section 50. The control section 70 determines whether or not the notification from each of the interface circuit 513, the interface circuit 523, the interface circuit 533, and the wireless communication section 540 has been input to determine whether or not the input of the image signal exists in each of the interfaces of the interface section 50.

When the control section 70 cannot detect the interface in which the input of the image signal exists (NO in the step S3), the control section 70 rewrites the value of the flag for switching between the valid state and the invalid state of the automatic input detection function to the value corresponding to the valid state to set (step S10) the automatic input detection function valid. Subsequently, the control section 70 controls the display section 20 to display (step S11) the home screen 110 on the screen SC. The step S11 corresponds to the "image display step."

Further, when the interface in which the input of the image signal exists has been detected (YES in the step S3), the control section 70 displays (step S4) the image based on the image signal to be input to the interface thus detected on the screen SC as the input signal screen 100.

Then, the control section 70 determines (step S5) whether or not the input of the image signal continues. When the input of the image signal continues (YES in the step S5), the control section 70 determines (step S6) whether or not the display operation of the home screen 110 has been received. When the control section 70 has not received the display operation of the home screen 110 (NO in the step S6), the control section 70 returns to the step S4 to continue (step S4) to display the image based on the image signal.

Further, when the control section 70 has received the display operation of the home screen 110 (YES in the step S6), the control section 70 rewrites the value of the flag to the value corresponding to the invalid state to set (step S7) the automatic input detection function invalid. Subsequently, the control section 70 controls the display section 20 to display (step S11) the home screen 110 on the screen SC.

Further, when the control section 70 has determined that the input of the image signal has not existed in the step S5 (No in the step S5), the control section 70 determines (step S8) whether or not there is another interface in which the input of the image signal has been detected. When there is another such interface (YES in the step S8), the control section 70 returns to the step S4 to display (step S4) the image based on the image signal input to the another interface on the screen SC as the input signal screen 100.

Further, when the control section 70 has failed to detect the another interface (NO in the step S8), the control section 70 determines (step S9) whether or not the power switch has been operated to switch OFF the projector 1. When the projector 1 has been switched OFF (YES in the step S9), the control section 70 terminates the processing flow. Further, when the control section 70 has not been switched OFF (NO in the step S9), the control section 70 rewrites the value of the flag to the value corresponding to the valid state to set (step S10) the automatic input detection function valid. Then, the control section 70 makes the display section 20 to display (step S11) the home screen 110 on the screen SC.

Then, the control section 70 determines (step S12) whether or not the interface in which the input of the image signal exists has been detected. The step S12 corresponds to a "detection step." When the interface in which the input of the image signal exists has not been detected (NO in the step S12), the control section 70 returns to the step S12 to continuously determine whether or not there is the interface in which the input of the image signal exists.

When the interface in which the input of the image signal exists has been detected (YES in the step S12), the control section 70 refers to the flag to determine (step S13) whether or not the automatic input detection function is in the valid state or the invalid state. When the automatic input detection function is in the invalid state (NO in the step S13), the control section 70 continues (step S14) the display of the home screen 110. Subsequently, the control section 70 determines (step S15) whether or not an operation of selecting the interface from the interfaces displayed in the home screen 110 has been received. When the control section 70 has not received the operation of selecting the interface (NO in the step S15), the control section 70 returns to the step S14 to continue to display the home screen 110.

Further, when the control section 70 has received the operation of selecting the interface (YES in the step S15), the control section 70 displays (step S16) the image based on the image signal to be input to the interface thus selected as the input signal screen 100, and then makes the transition to the process in the step S4. The step S13, the step S14, the step S15, and the step S16 correspond to a "selection step."

Further, when the control section 70 has referred to the flag to determine that the automatic input detection function is in the valid state (YES in the step S13), the control section 70 displays (step S16) the image based on the image signal to be input to the interface detected in the step S12 as the input signal screen 100. Subsequently, the control section 70 makes the transition to the process of the step S4.

As described hereinabove, the projector 1 according to the first embodiment executes the screen display step corresponding to the step S11 in the flowchart shown in FIG. 5, the detection step corresponding to the step S12 in the flowchart shown in FIG. 6, and the selection step corresponding to any one of the step S13, the step S14, the step S15, and the step S16 shown in FIG. 6.

In the screen display step, when the input of the image signal to the interface section 50 is not detected, or when the operation has been received by the remote controller 5 or the operation panel 13, the display section 20 is made to display the home screen 110 for selecting any one of the interfaces.

In the detection step, the input of the image signal to the interface section 50 is detected.

In the selection step, an image to be displayed by the display section is selected.

Further, in the selection step, when the home screen 110 has been displayed on the grounds that the operation has been received by the remote controller 5 or the operation panel 13 in the screen display step, even when the input of the image signal to the interface section 50 has been detected, the image of the home screen 110 is selected as the image to be displayed by the display section 20.

Further, in the selection step, when the home screen 110 has been displayed on the grounds that the input of the image signal to the interface section 50 has not been detected in the screen display step, when the input of the image signal to the interface section 50 is detected, the image based on the image signal the input of which has been detected is selected as the image to be displayed by the display section 20.

Therefore, when the user operates the remote controller 5 or the operation panel 13 to display the home screen 110, even when the input of the image signal to the interface section 50 is detected, it is possible to continue the display of the home screen 110. Therefore, it is possible to prevent the home screen 110 from being switched due to the input of the image signal. Further, when the home screen 110 has been displayed irrespective of the operation by the user, it is possible to display the image based on the image signal thus detected when the input of the image signal is detected, and it is possible to display the image based on the image signal without the operation by the user.

Further, in the home screen 110, there is displayed the plurality of sub-screens 111 through 114 associated with the respective interfaces, and in the plurality of sub-screens 111 through 114, there are displayed the images based on the image signals input to the interfaces with which the sub-screens 111 through 114 are associated.

In the selection step, when the operation of selecting any one of the sub-screens 111 through 114 has been received by the remote controller 5 or the operation panel 13, the image displayed by the display section 20 is changed from the home screen 110 to the image based on the image signal to be input to the interface associated with one of the sub-screens 111 through 114 selected by the operation.

Therefore, it is possible to select the image to be displayed by the display section 20 with reference to the display of the sub-screens 111 through 114.

Second Embodiment

Then, a second embodiment will be described. Since the configuration of the projector 1 according to the second embodiment is the same as that of the projector 1 according to the first embodiment shown in FIG. 1, the description of the configuration of the projector 1 will be omitted.

In the first embodiment described above, when the interface to which the image signal is input has been detected after displaying the home screen 110, whether the automatic input detection function is in the valid state or in the invalid state is judged to continue the display of the home screen 110 or to display the image based on the image signal thus input.

In the second embodiment, the image to be displayed on the screen SC is selected based on the setting on whether the automatic input detection function is in the valid state or in the invalid state and a selection condition set by the user. The user operates the remote controller 5 and the operation panel 13 to set any one of a first condition, a second condition, and a third condition to the projector 1 as the selection condition. The first condition, the second condition, and the third condition as the selection condition are each the selection condition when selecting the image to be displayed on the screen SC when the input of the image signal has been detected in the interface section 50 after displaying the home screen 110. The first condition is a setting of making the automatic input detection function always valid, and the second condition is a setting of making the automatic input detection function always invalid. Further, the third condition is a setting of changing the image to be displayed on the screen SC in accordance with whether the automatic input detection function is in the valid state or in the invalid state.

When the projector 1 is set to the first condition, the control section 70 sets the automatic input detection function always valid. In other words, even when the control section 70 has received the operation of the remote controller 5 or the operation panel 13 to display the home screen 110, the control section 70 sets the automatic input detection function valid. Thus, when the input of the image signal has been detected in any one of the interfaces in the state in which the home screen 110 has been displayed, the control section 70 displays the image based on the image signal thus input as the input signal screen 100 instead of the home screen 110.

Further, when the projector 1 is set to the second condition, the control section 70 sets the automatic input detection function always invalid. In other words, even when the input of the image signal has not been detected in any of the interfaces, and the control section 70 has displayed the home screen 110, the control section 70 sets the automatic input detection function invalid. Thus, when the input of the image signal has been detected in any one of the interfaces in the state in which the home screen 110 has been displayed, the control section 70 continues to display the home screen 110. Further, when any one of the sub-screens 111 through 114 displayed in the home screen 110 has been selected, the image based on the image signal to be input to the interface with which the sub-screen thus selected is associated is displayed.

Further, when the projector 1 is set to the third condition, the control section 70 sets the automatic input detection function as an automatic mode. Specifically, similarly to the first embodiment described above, when receiving the operation of the remote controller 5 or the operation panel 13 to display the home screen 110, the automatic input detection function is set invalid. Further, when the input of the image signal cannot be detected in any of the interfaces, and the home screen 110 has been displayed, the automatic input detection function is set valid.

The operation in the present embodiment will be described with reference to the flowchart shown in FIG. 7.

It should be noted that since the operation in the steps S1 through S12 shown in FIG. 5 and FIG. 6 is the same as the operation explained in the first embodiment described above, the detailed description will be omitted. Further, a determination process in the step S21 shown in FIG. 7 corresponds to a determination process in the step S12 shown in FIG. 6.

When the interface in which the input of the image signal exists has been detected (YES in the step S21), the control section 70 determines (step S22) whether or not the condition set to the projector 1 is the first condition. When the condition set to the projector 1 is the first condition (YES in the step S22), the control section 70 displays (step S23) the image based on the image signal input to the interface in which the input has been detected as the input signal screen 100. The control section 70 displays the image based on the image signal thus input as the input signal screen 100 irrespective of when displaying the home screen 110 displayed in the step S11 is displayed due to the reception of the operation, or when the home screen 110 displayed in the step S11 has been displayed on the grounds that the input of the image signal cannot be detected in any of the interfaces.

Further, when the condition set to the projector 1 is not the first condition (NO in the step S22), the control section 70 determines (step S24) whether or not the condition set to the projector 1 is the second condition. When the condition set to the projector 1 is the second condition (YES in the step S24), the control section 70 continues (step S25) to display the home screen 110. The control section 70 continues to display the home screen 110 irrespective of when displaying the home screen 110 displayed in the step S11 is displayed due to the reception of the operation, or when the home screen 110 displayed in the step S11 has been displayed on the grounds that the input of the image signal cannot be detected in any of the interfaces.

Further, when the control section 70 has determined that the condition set to the projector 1 is not the second condition (NO in the step S24), the control section 70 determines that the condition set to the projector 1 is the third condition. In this case, the control section 70 performs the same process as in the steps S13 through S16 in the flowchart shown in FIG. 6.

As described hereinabove, in the selection step, when the first condition is set as the selection condition, the projector 1 according to the second embodiment selects the image based on the image signal the input of which has been detected as the image to be displayed by the display section 20 irrespective of the conditions of displaying the home screen 110, namely when the home screen 110 has been displayed on the grounds that the operation has been received by the remote controller 5 or the operation panel 13, or when the home screen 110 has been displayed on the grounds that no input of the image signal to the interface section 50 has been detected.

Therefore, by setting the first condition, when the input of the image signal is detected, it is possible to display the image based on the image signal thus detected irrespective of the conditions in which the home screen 110 has been displayed.

Further, in the selection step, when the second condition is set as the selection condition, the home screen 110 is selected as the image to be displayed by the display section 20 irrespective of the conditions of displaying the home screen 110, namely when the home screen 110 has been displayed on the grounds that the operation has been received by the remote controller 5 or the operation panel 13, or when the home screen 110 has been displayed on the grounds that no input of the image signal to the interface section 50 has been detected.

Therefore, by setting the second condition, it is possible to continue to display the home screen 110 even when the image signal is input irrespective of the conditions in which the home screen 110 has been displayed.

Further, in the selection step, when the third condition is set as the selection condition, the image of the home screen 110 is selected as the image to be displayed by the display section even when the input of the image signal to the interface section 50 is detected when the home screen 110 has been displayed on the grounds that the operation has been received by the reception section, and the image to be displayed by the display section is changed from the image of the home screen 110 to the image based on the image signal the input of which has been detected when the input of the image signal to the interface section 50 is detected when the home screen 110 has been displayed on the grounds that no input of the image signal to the interface section 50 has detected.

Therefore, by setting the third condition, it is possible to change the image to be displayed by the display section 20 when the image signal is input between when the home screen 110 has been displayed on the grounds that the operation has been received by the reception section and when the home screen 110 has been displayed on the grounds that no input of the image signal to the interface section 50 has been detected.

The embodiments described above are nothing more than examples of a specific aspect to which the present disclosure is applied, and therefore, do not limit the present disclosure. Therefore, it is also possible to implement the present disclosure as different aspects.

For example, although in the embodiments described above, there is described when the interface circuit 513, the interface circuit 523, the interface circuit 533, and the wireless communication section 540 act as the detection section, it is also possible to make the control section 70 act as the detection section.

For example, it is also possible for the control section 70 to identify the input of the image signal and the interface to which the image signal has been input by the sync signals being input from the first interface 510, the second interface 520, the communication interface 530, and the wireless communication section 540.

Further, although in the first and second embodiments described above, the projector 1 is described as an example of the display device, the display device according to the present disclosure can also be a liquid crystal display. Further, the display device equipped with a plasma display panel or an organic EL panel can also be adopted.

Further, when realizing the method of controlling the display device using a computer provided to the display device, it is also possible to configure the program to be executed by the computer as an aspect of a recording medium, or an aspect of a transmission medium for transmitting the program. As the recording medium, there can be used a magnetic or optical recording medium, or a semiconductor memory device. Specifically, there can be cited a portable or rigid recording medium such as a flexible disk, an HDD (Hard Disk Drive), a CD-ROM (Compact Disc Read Only Memory), a DVD (Digital Versatile Disc), a Blu-ray disc, a magnetooptic disc, a flash memory, or a card-type recording medium. Further, the recording medium described above can also be a RAM (Random Access Memory), or a nonvolatile storage device such as a ROM (Read Only Memory) or the HDD as an internal storage device provided to the image display device. Blu-ray is a registered trademark.

Figure 7:
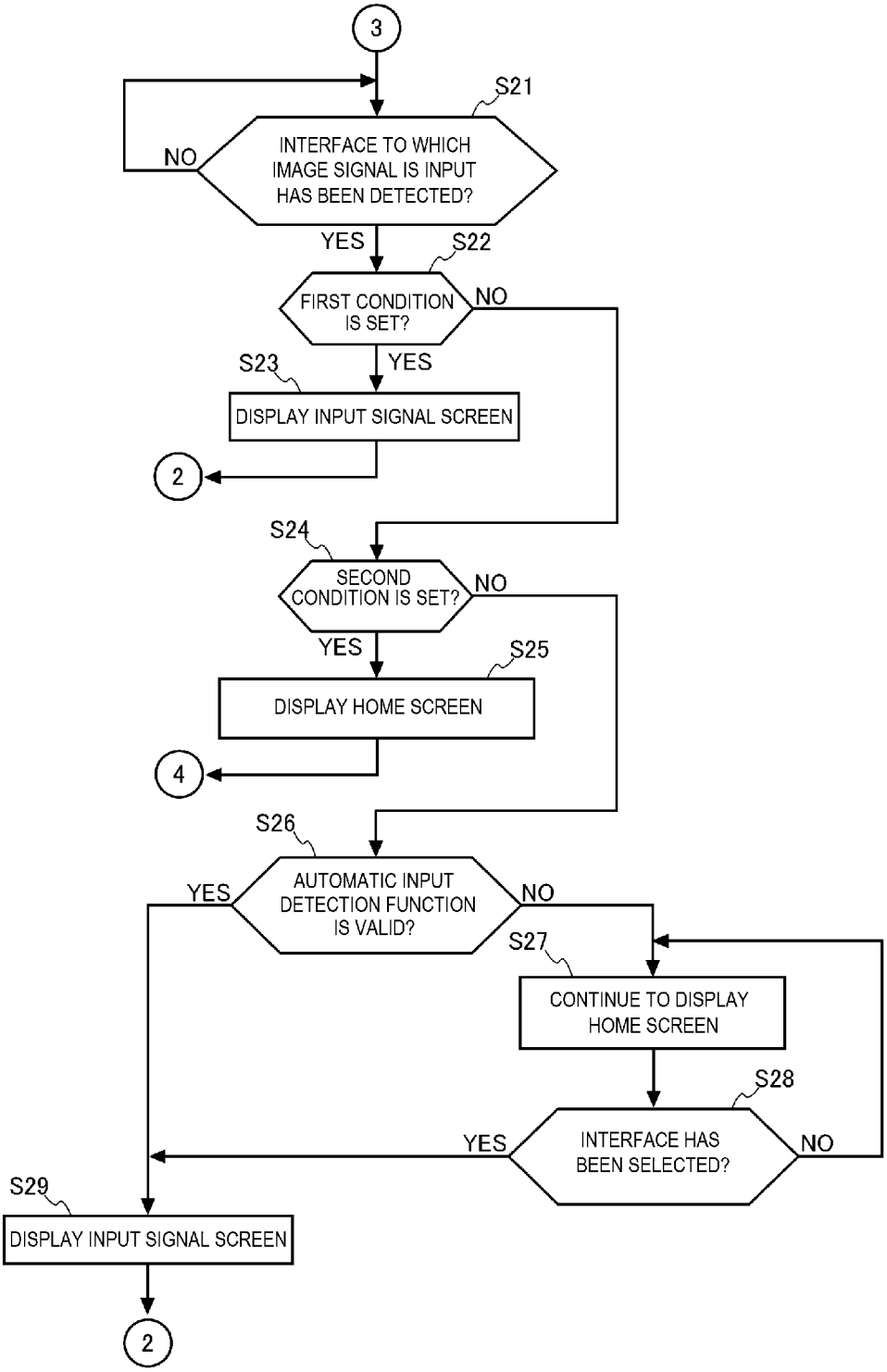
FIG. 7 is a flowchart showing an operation of a second embodiment.

Further, the processing units of the flowcharts shown in FIG. 5 through FIG. 7 are obtained by dividing the process of the control section 70 in accordance with major processing contents in order to make the process of the control section 70 easy to understand. Therefore, the scope of the present disclosure is not limited by the way of the division or the names of the processing units shown in the flowcharts of FIG. 5 through FIG. 7. Further, the process of the control section 70 can also be divided into a larger number of processing units, or can also be divided so that one processing unit includes a larger amount of process in accordance with the processing contents. Further, the processing sequence of the flowchart described above is not limited to the illustrated example.

Further, at least some of the functional blocks of the projector 1 shown in FIG. 1 can be realized by hardware, and it is possible to adopt a configuration realized by cooperation between the hardware and the software. Further, the configuration of arranging the independent hardware resources as shown in the drawings is not a limitation, but it is also possible to adopt a configuration provided with other functional sections than illustrated ones.

What is claimed is:

1. A method of controlling a display device, the method comprising:

a screen display step of displaying, by a display screen of a display section, a selection screen to select an interface of a plurality of interfaces when no input of an image signal is detected to a coupling section of each interface of the plurality of interfaces coupled to a corresponding external device and when an operation is received by a reception section;

a setting step of receiving a user input and setting one of a first condition, a second condition, and a third condition based on the user input, the first condition setting an automatic input detection function to be always valid, the second condition setting the automatic input detection function to be always invalid, and the third condition is a setting of automatically changing an image to be displayed on the display screen in accordance with whether the automatic input detection function is in the valid state or in the invalid state;

a detection step of detecting input of the image signal to the coupling section; and a selection step of:

when the first condition is set, selecting and displaying the image of the image signal by the display section in response to detecting the input of the image signal to the coupling section, regardless of receiving the operation by the reception section to instruct display of the selection screen, when the second condition is set, selecting and displaying an image of the selection screen by the display section, regardless of detecting the input of the image signal to the coupling section, and when the third condition is set, (i) selecting the image of the selection screen to be displayed by the display section when no input of the image signal is detected, which sets the automatic input detection function as in the valid state, (ii) when the automatic input detection function is set to the valid state, automatically changing the display section from displaying the selection screen to displaying the image of the image signal by the display section in response to detecting the input of the image signal to the coupling section, and (iii) in response to receiving the operation by the reception section to instruct display of the selection screen, which sets the automatic input detection function as in the invalid state, selecting and continuing to display the selection screen in the screen display step even when the input of the image signal to the coupling section is detected.

2. The method of controlling a display device according to claim 1, wherein in the selection step, when the input of the image signal is detected after displaying the selection screen, and when the first condition is set, the image to be displayed by the display section based on detecting the input of the image signal is selected as the image to be displayed by the display section when the selection screen is displayed based on receiving the operation by the reception section and when the selection screen is displayed based on detecting no input of the image signal to the coupling section.

3. The method of controlling a display device according to claim 1, wherein in the selection step, when the input of the image signal is detected after displaying the selection screen, and when the second condition is set, the image of the selection screen is selected as the image to be displayed by the display section when the selection screen is displayed based on the operation received by the reception section and when the selection screen is displayed based on detecting no input of the image signal to the coupling section.

4. The method of controlling a display device according to claim 1, wherein in the selection step, when the input of the image signal is detected after displaying the selection screen, and when the third condition is set:

when the selection screen is displayed based on receiving the operation by the reception section, the image of the selection screen is selected as the image to be displayed by the display section even when the input of the image signal to the coupling section is detected, and when the selection screen is displayed based on detecting no input of the image signal to the coupling section, the image to be displayed by the display section is changed from the image of the selection screen to the image based on the image signal when detecting the input of the image signal.

5. The method of controlling a display device according to claim 1, wherein:

a plurality of sub-screens respectively associated with the plurality of interfaces is displayed in the selection screen, a plurality of images based on the image signals input to the interfaces with which the sub-screens are associated are respectively displayed in the plurality of sub-screens, and in the selection step, when an operation of selecting any of the plurality of sub-screens is received by the reception section, the image to be displayed by the display section is changed from the selection screen to the image based on the image signal input to the interface associated with the sub-screen selected by the operation received by the reception section.

6. A display device comprising:

a display section including a display;

a reception section configured to receive an operation;

a coupling section include a plurality of interfaces to respectively connect to an external device;

a detection section configured to detect an input of an image signal to the coupling section; and a display control section configured to control the display section to display a selection screen used to select one of the plurality of interfaces, the display control section setting one of a first condition, a second condition, and a third condition based on a user input, the first condition setting an automatic input detection function to be always valid, the second condition setting the automatic input detection function to be always invalid, and the third condition is a setting of automatically changing an image to be displayed on the display screen in accordance with whether the automatic input detection function is in the valid state or in the invalid state, the display control section:

when the first condition is set, selecting and displaying the image of the image signal by the display section in response to detecting the input of the image signal to the coupling section, regardless of receiving the operation by the reception section to instruct display of the selection screen, when the second condition is set, selecting and displaying an image of the selection screen by the display section, regardless of detecting the input of the image signal to the coupling section, and when the third condition is set, (i) selecting the image of the selection screen to be displayed by the display section when no input of the image signal is detected, which sets the automatic input detection function as in the valid state, (ii) when the automatic input detection function is set to the valid state, automatically changing the display section from displaying the selection screen to displaying the image of the image signal by the display section in response to detecting the input of the image signal to the coupling section, and (iii) in response to receiving the operation by the reception section to instruct display of the selection screen, which sets the automatic input detection function as in the invalid state, selecting and continuing to display the selection screen in the screen display step even when the input of the image signal to the coupling section is detected.

* * * * *